US005441386A

United States Patent [19]

Hsieh

[11] Patent Number: 5,441,386

[45] Date of Patent: Aug. 15, 1995

[54] LUBRICATING SYSTEM FOR COOLING FANS

[76] Inventor: Hsin M. Hsieh, No. 6, Kung Ye 6th Road, West Section, Ping Tung City, Taiwan

[21] Appl. No.: 282,431

[22] Filed: Jul. 29, 1994

[51] Int. Cl.[6] ..... F04D 29/12

[52] U.S. Cl. ..... 415/230; 415/229; 277/67; 277/133; 384/279; 384/286

[58] Field of Search ..... 415/111, 112, 113, 168.2, 415/168.4, 174.3, 229, 230, 231; 277/133, 67; 384/152, 279, 286, 902

[56] References Cited

U.S. PATENT DOCUMENTS

| | | | |
|---|---|---|---|
| 3,703,221 | 11/1972 | Merkle et al. | 277/133 |
| 4,558,960 | 12/1985 | Lehtinen et al. | 384/286 |

FOREIGN PATENT DOCUMENTS

| | | | |
|---|---|---|---|
| 0614551 | 2/1961 | Canada | 384/152 |
| 2503280 | 10/1982 | France | 415/230 |
| 0027795 | 1/1992 | Japan | 415/229 |
| 2217784 | 11/1989 | United Kingdom | 415/229 |
| 0954656 | 9/1982 | U.S.S.R. | 415/112 |

*Primary Examiner*—Edward K. Look
*Assistant Examiner*—Christopher Verdier

[57] ABSTRACT

A lubricating system for cooling fans is provided and mainly consists of a self-lubricating bearing, an oil retaining cap, and an oil retaining ring. The oil retaining ring has a central hole, an inner portion adjacent to the central hole and having a round cross section, and an outer flange portion integrally extended from the inner portion and having a concavo-concave cross section. The oil retaining cap is bowl-shaped and has a central opening, an inner convex portion, and an outer concave portion. The self-lubricating bearing has two end surfaces each of them being provided with a plurality of shallow bevel grooves inclining toward an axially extended shaft hole of the bearing, and an annular recess formed at a middle section of the shaft hole. With these arrangements, lubricant being sucked and jetted from the self-lubricating bearing during the rotation of the locating shaft of the cooling fan relative to the self-lubricating bearing can be reduced, that is, the oil loss of the self-lubricating bearing can be minimized and the usable life of the cooling fan can be prolonged due to smoother rotation of the locating shaft thereof.

2 Claims, 5 Drawing Sheets

LUBRICATING SYSTEM FOR COOLING FANS

BACKGROUND OF THE INVENTION

A cooling fan is a very commonly used means for cooling and dissipating heat and is mainly installed in an electronic or electrically powered unit to discharge heat generated by the electronic or electrical unit during its operation. By this way, the electronic and/or electrical unit and the elements thereof are adequately protected from being damaged by the high temperature and thereby have prolonged life. Most of the office machines, such as the main unit of computers, video tape recorders and copiers, are equipped with a cooling fan.

A conventional cooling fan 60, as shown in FIG. 5, usually includes a blade support 61 and main body 62. The blade support and 61 has a hollow central support from a circumferential periphery thereof a plurality of blades 611 are provided. A magnet 612 is fittingly attached to an inner wall of the hollow central support and a central locating shaft 613 axially projects forward from the hollow central support. The main body 62 has a fixedly centered blade holder 621 which includes a backward extended column 622. The column 622 has an axially extended central through hole 623. A middle portion of the through hole 623 is radially raised to form a circle of bearing surface 624 to receive a self-lubricating bearing 63 therein. The self-lubricating bearing 63 has a central shaft hole 631 formed therein to receive the locating shaft 613 of the blade support 61. A circuit board 625 and a coil 626 are provided outside the column 622 for electrically controlling the movement of blades 611.

To assemble the cooling fan 60, directly insert the locating shaft 613 of the blade support 61 into the shaft hole 631 of the bearing 63; a first and a second oil ring 614, 615 having a round cross section are put over the locating shaft 613 to contact a rear and a front end surface of the self-lubricating bearing 63, respectively. A retaining ring 616 positioned in front of the second oil ring 615 is used to hold the locating shaft 613 so that a front head portion of the latter is securely kept projecting out of the shaft hole 631. The magnet 612 is provided at an outer periphery of the coil 626 such that the locating shaft 613 rotates in the shaft hole 631 relative to the self-lubricating bearing 63 to turn the blade support 61 and the blades 611, accordingly, when the circuit board 625 and the coil 626 are electrically made.

When the locating shaft 613 rotates relative to the self-lubricating bearing 63, lubricant pre-stored in the latter will be released from sintering pores of the bearing 63 to lubricate the same and the locating shaft 613.

The above lubricating system usually adopted by the conventional cooling fans has the following shortcomings. Please refer to FIG. 6, when the first and the second oil rings 614, 615 rotate with the locating shaft 613, a friction generated between the oil rings 614, 615 and the end surfaces of the self-lubricating bearing 63 shall suck a part of the lubricant in the self-lubricating bearing 63 from the sintering pore of the latter. The sucked lubricant shall then be jetted around due to the centrifugal force generated during the rotation of the oil rings 614, 615. A part of the lubricant jetted from the first oil ring 614 flows out of the through hole 623 of the column 622 via gaps 71 between the end surface of the bearing 63 and the oil ring 614 and therefore, causes the lubricant inside the bearing 63 to gradually lose and decrease. When the lubricant inside the self-lubricating bearing 63 is exhausted, no lubricant ban be used to lubricate the locating shaft 613 and the bearing 63 and over friction will be caused during further rotation of the locating shaft 613 in the bearing 63. The locating shaft 613 and the bearing 63 are both easily worn and damaged to produce noise and shorten the usable life of cooling fans 60 under this no-lubrication condition.

Lubricant jetted from the second oil ring 615 is retained in a closed room of the through hole 623 between a front end surface of the bearing 63 and an oil cap covered in front of the blade holder 621 and has not any lubricating effect on the bearing 63 itself and on the end surface of the bearing 63 contacting the first oil ring 614, but to locally lubricate the end surface of the bearing 63 contacting the second oil ring 615 via natural flowing.

Since the bearing and the oil rings are important parts in the lubricating system of a cooling fan, it is necessary to have a new lubricating system with desirable structure to use with a cooling fan, so that the oil loss rate of the self-lubricating bearing can be minimized to prolong the life of the cooling fan and to better smooth the rotating of the locating shaft of the blades.

SUMMARY OF THE INVENTION

The lubricating system fan cooling fans according to the present invention is characterized in an oil retaining ring and an oil retaining cap separately disposed at two ends of the self-lubricating bearing. The oil retaining ring includes a round-sectioned inner annular portion and a concavo-concave-sectioned outer flange portion integrally extending outward from the round-sectioned inner portion. The oil retaining cap is in the form of a bowl and has a centered opening. The oil retaining cap has an inner surface which has an inner portion adjacent to the central opening and having a convex profile and an outer portion surrounding the inner portion and having a concave profile. The present invention is also characterized in a plurality of shallow bevel grooves formed on the end surfaces of the self-lubricating bearing and thereby, when the locating shaft is inserted into the self-lubricating bearing with the oil retaining cap and the oil retaining ring separately disposed at and contacting the front and the rear end surface of the bearing, lubricant sucked and jetted by the centrifugal force at the contact surfaces between the bearing and the oil retaining cap and the oil retaining ring is guided to flow back to the self-lubricating bearing along the bevel grooves, thereby reducing the oil loss and prolonging the usable life of the bearing and the locating shaft. This is also the primary object of the present invention.

DETAILED DESCRIPTION OF THE PREFERRED EMBODIMENTS

Figures 1, 1A:
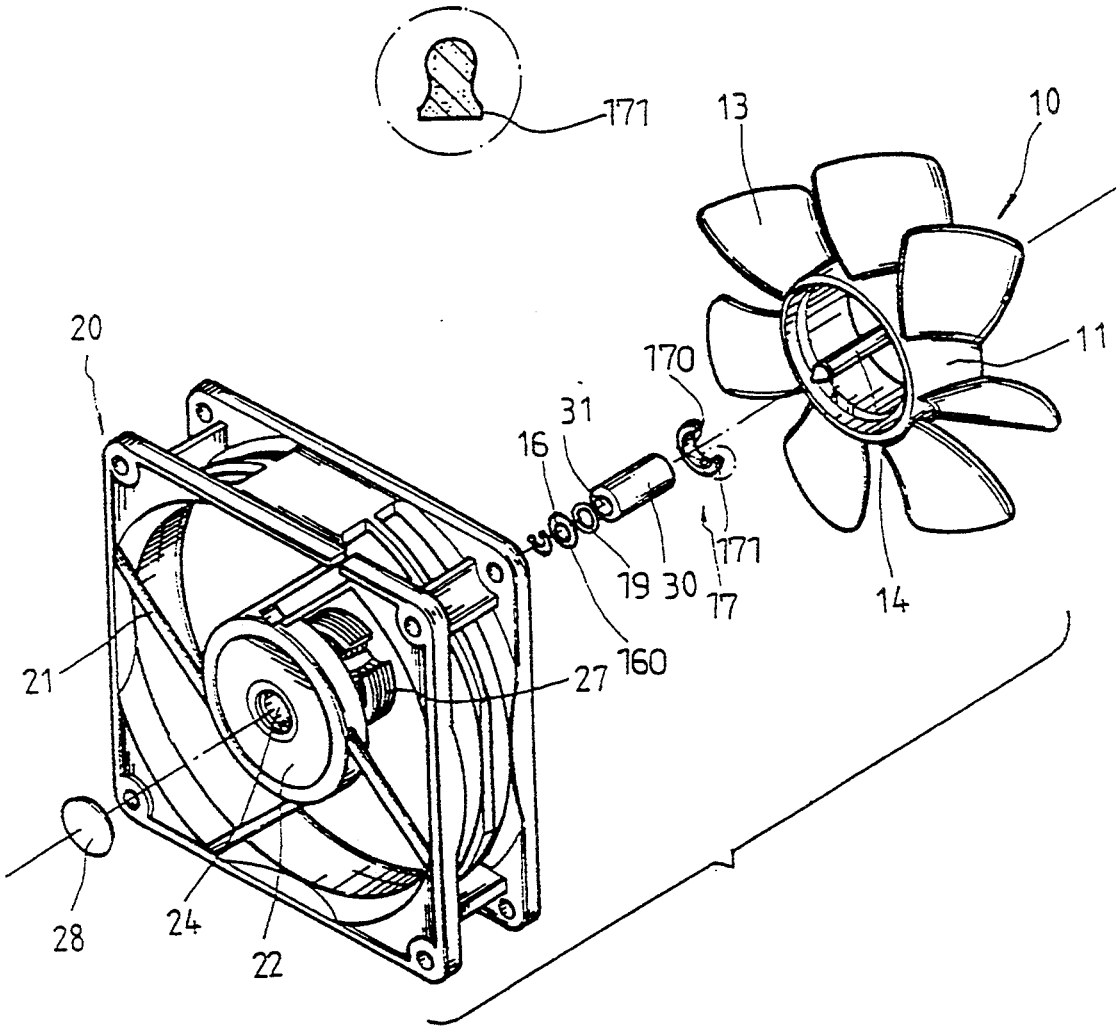
FIG. 1 is a disassembled perspective of a cooling fan according to an embodiment of the present invention.
Figure 2:
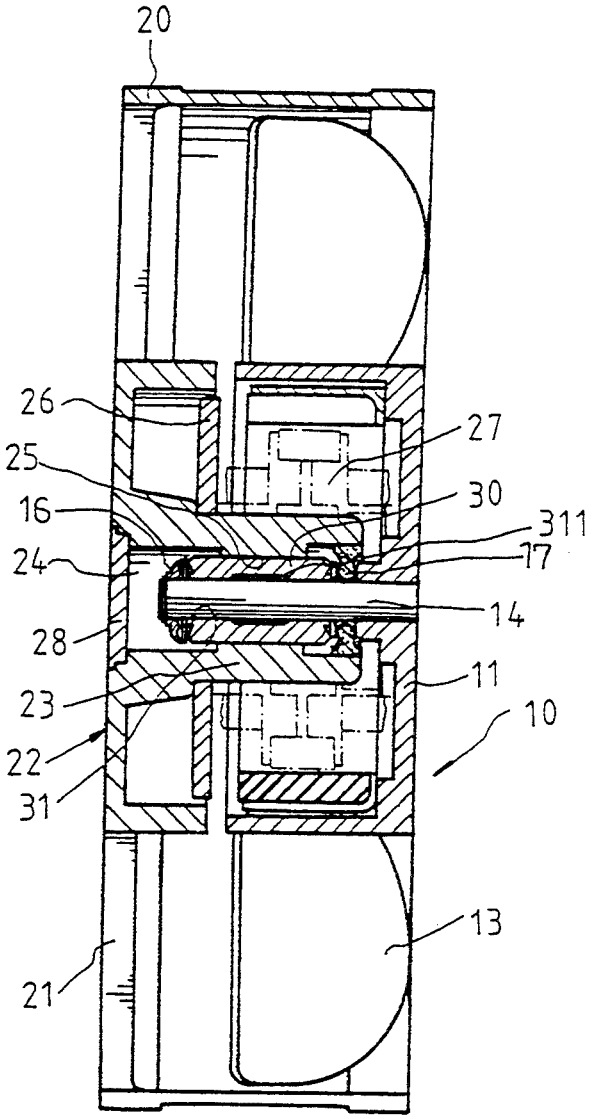
FIG. 2 is an assembled side sectional view according to FIG. 1.

Please refer to FIG. 1. A cooling fan mainly consists of a blade support 10 and a main body 20. The blade support 10 has a hollow central support 11 from an outer periphery thereof a plurality of blades 13 extend. A locating shaft 14 projects forward from a central portion of the support 11. The main body 20 has a blade holder 22 being fixed to a middle portion of the main body 20 by means of several ribs 21. Please refer to FIG.2, the blade holder 22 has a backward extended column 23 which is formed with a central through hole 24. The through hole 24 has a stepped front inner portion to be fittingly and tightly covered by an oil seal 28 having a flange formed at a front end thereof. The through hole 24 further has a radially raised middle portion which forms a circle of bearing surface 25. A circuit board 26 and a coil 27 are provided at an outer periphery of the column 23. A self-lubricating bearing 30 is inserted into the through hole 24 of the blade holder 22 and securely held by the bearing surface 25.

To assemble the cooling fan, just place the blade support 10 into the main body 20 with the locating shaft 14 extending through an axially extended shaft hole 31 of the self-lubricating bearing 30 to project its front end into a closed room of the through hole 24 formed between the oil seal 28 and a front end of the self-lubricating bearing 30. Washers 19 put over the locating shaft 14 are separately disposed adjacent to two ends of the self-lubricating bearing 30. An oil retaining cap 16 having a central opening 160 is put over a front end of the locating shaft 14 before the front washer 19 and an oil retaining ring 17 is put over the locating shaft 14 to press against the rear washer 19. After the blade support 10 is fixed in the main body 20, the oil seal 28 is used to cover the stepped front end of the through hole 24. The self-lubricating bearing 30 is made of sintered copper alloy and contains a large quantity of lubricant which will be released from the bearing 30 to lubricate the same when the surface of the bearing 30 is subjected to a frictional force.

The lubricating system for a cooling fan according to the present invention is characterized in the oil retaining cap 16, the oil retaining ring 17, and the self-lubricating bearing 30 which has two grooved ends and an inner annular recess 311. Please refer to FIGS. 2 and 3 for the detailed structure of these three important components. The self-lubricating bearing 30 is provided at an inner middle section of its shaft hole 31 with an annular recess 311 which has a larger diameter than the other portion of the shaft hole 31, and at two ends thereof with a plurality of shallow bevel grooves 3, as shown in FIG. 4. The bevel grooves 301 each have a bevelled surface inclining toward the shaft hole 31. The oil retaining ring 17 has a central hole 170, a round-sectioned inner portion adjacent to the central hole 170, and a concavo-concave-sectioned outer flange portion 171 integrally extending from the round-sectioned inner portion. The oil retaining cap 16 is in the form of a bowl and has a central opening 160 for the cap 16 to fitly engage with the locating shaft 14. The oil retaining cap 16 has an inner surface which has an inner portion adjacent to the central opening 160 and having a convex profile and an outer portion surrounding the inner portion and having a concave profile. The curve outer and inner portions of the oil retaining cap 16 are both capable of guiding oil to flow back to the self-lubricating bearing 30.

Figure 3:
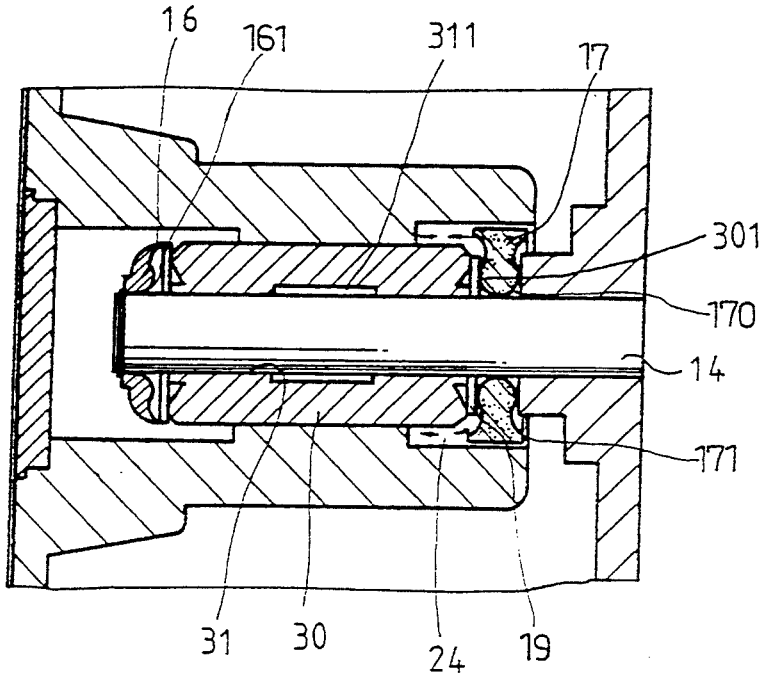
FIG. 3 is a partially enlarged side sectional view of FIG. 2, showing the structure of the lubricating system of the present invention.
Figure 4:
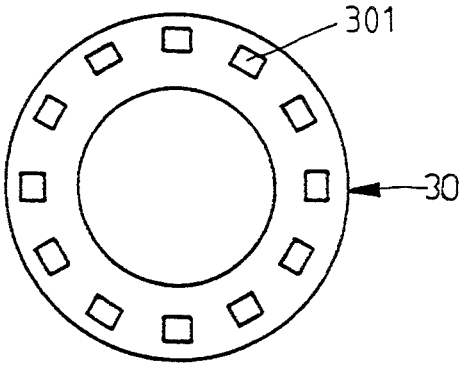
FIG. 4 is an end view showing one end surface of the self-lubricating bearing according to the present invention.
Figure 5:
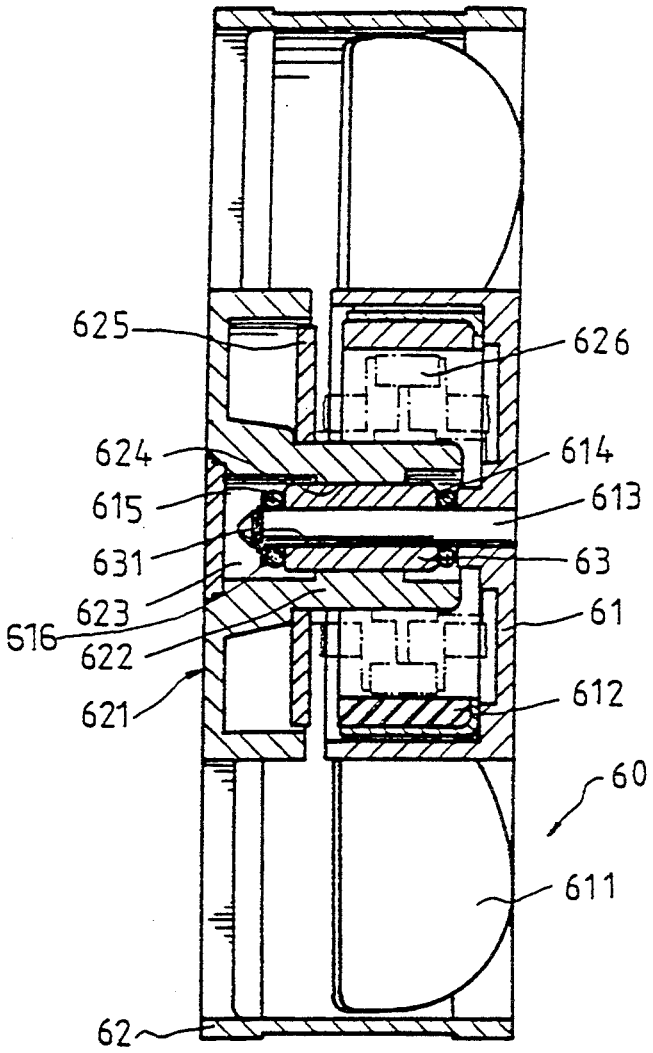
FIG.5 PRIOR ART
FIG. 5 is an assembled side sectional view of a conventional cooling fan.
Figure 6:
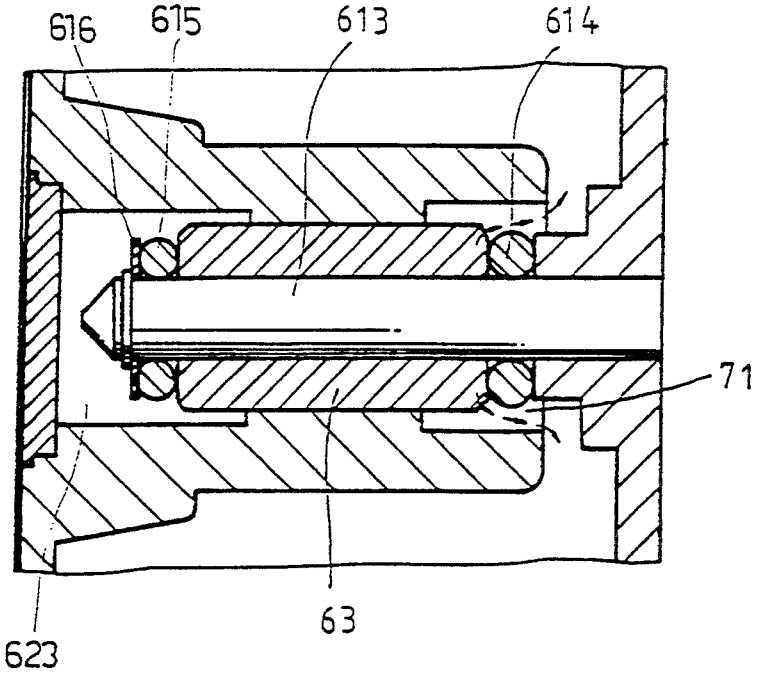
FIG. 6 PRIOR ART
FIG. 6 is a partially enlarged side sectional view of FIG. 5, showing the structure of the conventional lubricating system of a cooling fan.

Also please refer to FIGS. 1 and 3 for the operation of the lubricating system of the present invention. The locating shaft 14 drives the blades 13 of the cooling fan to rotate while it rotates in that shaft hole 31 of the self-lubricating bearing 30. This produces friction between the surfaces of the locating shaft 14 and the bearing 30 and therefore generates a suction to suck the lubricant contained in the bearing 30 so that the lubricant is released from the sintering pores of the bearing 30 to lubricate the bearing 30 and the locating shaft 14, and to reduce the friction coefficient. At this point, lubricant is also sucked and released from two ends of the self-lubricating bearing 30 due to the friction between the end surfaces of the bearing 30 and the washers 19 or the oil retaining cap 16 and the oil retaining ring 17. The lubricant released from the two end surfaces of the bearing 30 is jetted around due to the centrifugal force generated during the rotation. With the present invention, the lubricant jetted from the rear end of the bearing 30 is guided by the concavo-concave-sectioned flange portion 171 of the oil retaining ring 17 to flow back to the self-lubricating bearing 30 while the lubricant jetted from the front end of the bearing 30 into the front closed room in front of the through hole 24 is guided by the concave and the convex curve of the bolt-shaped oil retaining cap 16 to flow back and penetrate into the self-lubricating bearing 30. The lubricant can therefore be effectively circulated. That is, when the lubricant is jetted around due to the centrifugal force generated during the rotation of the locating shaft 14 relative to the self-lubricating bearing 30, it is retained and guided by the curvy oil retaining cap 16 and oil retaining ring 17 to flow back toward the friction surface between the locating shaft 14 and the bearing 30, and is forced to penetrate into the pores of the sintered self-lubricating bearing 30, enabling the lubricant to distribute more evenly in the clearance between the locating shaft 14 and the bearing 30 to better smooth the rotation of the locating shift 14.

The bevel grooves 301 provided on two end surfaces of the self-lubricating bearing 30 reduce the contact surfaces between the self-lubricating bearing 30 and the oil retaining cap 16 and the oil retaining ring 17 and therefore decreases the lubricant sucked from the end surfaces of the bearing 30 by the frictional force. Moreover, the bevel grooves 301 guide the lubricant released from the end surfaces of the bearing 30 and retained by the oil retaining cap 16 and the oil retaining ring 17 to flow along the grooves 301 and back to the self-lubricating bearing 30 and thereby minimizes the lubricant being jetted around. Furthermore, the inner annular recess 311 formed inside the shaft hole 31 of the bearing 30 has the function to reduce friction between the locating shaft 14 and the bearing 30 as well as to store more lubricant in the self-lubricating bearing 30, facilitating the even distribution of lubricant in the clearance between the locating shaft 14 and the bearing 30 and accordingly, the smooth rotation of the locating shaft 14 relative to the bearing 30. With the self-lubricating bearing 30 having bevel grooves 301 formed on two end surfaces thereof and an annular recess with larger diameter, and the oil retaining cap 16 and the oil retaining ring 17 having a specially designed configuration, the lubricating system according to the present invention efffectively minimizes the oil loss and prolongs the usable life of the cooling fan.

What is claimed is:

1. A lubricating system for cooling fans which mainly consist of a main body having a blade holder and a blade support having a plurality of blades and a locating shaft suitable for extending into and engaging with said blade holder of the main body, comprising a self-lubricating bearing, an oil retaining ring disposed adjacent to a rear end surface of said self-lubricating bearing, and an oil retaining cap disposed adjacent to a front end surface of said self-lubricating bearing;

said self-lubricating bearing having an axially extended central shaft hole for receiving said locating shaft of said blade support to rotate therein relative to said self-lubricating bearing, and two end surfaces each having a plurality of shallow bevel grooves inclining toward said shaft hole to reduce friction between said end surfaces of said self-lubricating bearing and said oil retaining cap and ring and to facilitate the flow back of lubricant to said self-lubricating bearing;

said oil retaining cap having a central opening for said locating shaft to extend through and being bowl-shaped to have an inner portion which is adjacent to said central opening and has a convex profile and an outer portion which surrounds said inner portion and has a concave profile; and said oil retaining ring having a central hole, a round-sectioned inner portion adjacent to said central hole, and a concavo-concave-sectioned outer flange portion integrally extending from said round-sectioned inner portion.

2. A lubricating system for cooling fans as claimed in claim 1, wherein said shaft hole of said self-lubricating bearing is provided at a middle section with an annular recess which has a larger diameter than that of the rest of the part of said shaft hole and thereby reduces the friction between said locating shaft and said self-lubricating bearing and increases lubricant that can be stored in said self-lubricating bearing to smooth the rotation of said cooling fans.

* * * * *